US005782002A

United States Patent [19]

Reed

[11] Patent Number: 5,782,002

[45] Date of Patent: Jul. 21, 1998

[54] LASER GUIDANCE MEANS

[76] Inventor: Edwin D. Reed, R.R. 1, Box 175B, Whiteland, Ind. 46184

[21] Appl. No.: 660,167

[22] Filed: Jun. 3, 1996

[51] Int. Cl.[6] ..... F41G 1/467

[52] U.S. Cl. ..... 33/265; 33/283; 33/DIG. 1; 124/87

[58] Field of Search ..... 33/265, 241, 259, 33/283, DIG. 21; 124/87

[56] References Cited

U.S. PATENT DOCUMENTS 3,013,336 12/1961 Pennington ..... 33/265
4,616,422 10/1986 Gaddy ..... 33/265
4,961,265 10/1990 Roberts ..... 33/265
5,117,804 6/1992 Jörlöv ..... 124/87
5,419,050 5/1995 Moore ..... 33/265
5,495,675 3/1996 Huang ..... 33/265

*Primary Examiner*—Christopher W. Fulton

[57] ABSTRACT

Laser guidance apparatus for providing great accuracy of aiming a bow-and-arrow assembly. The apparatus provides a cam member which provides a double-adjustment feature of the inclination necessary for the proper trajectory of the arrow, taking account of the difference between the aiming inclination for a desired shot trajectory and the non-effect of gravity on the laser beam; and a cam member provides both the adjustment of the inclination to adjust for distance to the target, and for differences in the shooting assembly factors of arrow weight, pulling force, etc.

8 Claims, 11 Drawing Sheets

LASER GUIDANCE MEANS

I. FIELD AND BACKGROUND OF THE INVENTION

The present invention relates to equipment for use in the activity of shooting an arrow by a bow, more particularly to an apparatus for the laser guidance of the aiming function used by the shooter.

II. BASIC PRINCIPLE AND SHORT SUMMARY

A basic principle utilized by the present invention is that gravity consistently gives a downward "drop effect" to an arrow as a projectile, during the entire distance which the arrow is traversing the ground; whereas a laser beam is unaffected by gravity.

Thus, the lowering of the laser with respect to the bow and to the bow-held arrow causes the sighting dot to be lowered, which in turn causes the hunter to have to raise the angle of his bow and the bow-held arrow in order to bring the sighting dot back to the desired elevation at the target distance which elevation-change causes a raising of the projectile's flight-trajectory.

Such type of adjustment is provided by a vertically movable and vertically adjustable cam member.

The second type of adjustment as to the inclination of the laser unit, with respect to the orientation of the bow and the laser housing, also is provided as a function of the cam. With respect to this type of adjustment, the rotatable laser unit is governed by the cam which is made to be stationary with respect to the earth.

That is, the pendulum-weighted body of the cam assembly causes the cam to remain in the same orientation with respect to the earth even though the bow's inclination is changed; and this also provides a coordination between the inclination of the bow with respect to the earth and the inclination of the laser unit.

III. COMPARISON OF THE PRESENT INVENTION WITH THE STANDARD BOW SHOOTING SIGHT SYSTEM

The inventive concepts may perhaps be most easily understood by comparison with a standard bow shooting sight system.

With a sight pin system for the bow and arrow equipment, the bow has a sight bracket installed on it. This sight bracket may have many sight pins, they being height indicator guides for various target distances, and provide for a range from about 10 to 50 yards.

These pins are located in the front of the bow window, and the sight pins are installed in a vertical line and adjusted so as to be able to guide for targets from 10 to 50 yards, the adjustment being needed to compensate for different characteristics of the particular bow and arrow system.

The top pin will be the "10 yard pin" and the hunter will use this sight pin when shooting at close targets.

The second pin will be the "20 yard pin", and the hunter will use this sight pin when shooting at targets at 20 yards, and so on to 50 yards.

In any case each pin is lower than the last, up to the "50 yard pin" which will be the lowest pin on the sight bracket.

For understanding, it is to be noted that the reason the "50 yard pin" is the lowest is because one must raise the bow, i.e., elevate the angle for a higher trajectory of the arrow, to get the arrow to go far enough and high enough, to hit the target that is 50 yards distant. When this "50 yard pin" is adjusted to this target, then the shooter will be able to shoot at the target accurately as to elevation, i.e., with a sufficiently raised trajectory to hit the target at that 50 yard distance.

With this understanding, it will be noted that the laser sight works the same way, except the laser's "sighting dot" will be projected to the target from the laser sight system. It is to be kept in mind that when a person is shooting the bow with the automatic sight system and he is incrementally raising the bow, the laser is rotating around the adjustable cam of this invention, this rotation of the laser unit causing the laser beam, and the red "sighting dot" on the target, which dot the laser beam produces, to change in elevation.

This achieves, e.g., that the more that the person raises his bow's inclination, the laser will be lowering its laser beam.

As the person raises the bow's inclination, the laser and its sighting dot lowers; and when the person lowers the bow's inclination, the laser and its sighting dot raises.

With the laser-controlled system of the present invention it is significant to understand that there are two variations or adjustments which are to be considered in achieving the desired shot-control.

One of those variations or adjustments is a physical raising or lowering of the support given to the forward end of the laser unit, the adjustment in this respect changing the relative inclination of the laser beam with respect to the laser unit's housing and bow. This vertical adjustment utilizes the controlled movability impartable by a manual adjustment; and to adjustably support the laser unit in this respect, the automatic laser sight system has a cam located under the front end of the laser unit, the cam providing a supportive surface which supports the laser unit, such as the support of a rotationally movable cam follower by a vertically movable cam.

Providing this vertical adjustment, the cam can be raised or lowered under the laser, by a rotatable control screw, changing the angle of the laser unit and the laser unit beam, with respect to the bow, according to the adjustment of the screw. I.e., when the cam is raised the laser will raise, and when the cam is lowered the laser will lower.

When shooting heavy arrows that will fall to the earth at a shorter distance than lighter arrows shot with the same force, the cam needs to be lowered to compensate for the arrow drop to a given target when adjusted to the particular target distance; and if one changes to a lighter arrow, the cam will need to be raised and adjusted to the lighter arrow so that the arrow will not shoot with an unduly high trajectory or over the desired target.

To explain the cam system further, it must be understood that this cam does not have to be round in shape, and it could vary somewhat to compensate for different bows and their characteristics.

For further understanding, consider the laser in a downwardly-pointed position, and at this position a person would be shooting at a target under the tree. As the hunter decides to shoot at a target 5 feet from the tree, for example, he will start raising his bow until the laser "sighting dot" is centered on the target 5 feet distant. In so doing the laser will have started rotating around the cam and lowering itself to the right position to shoot at this 5 feet target accurately.

Now suppose this person decides to shoot a target at 20 yard distant away. The same occurrences of laser and cam relationship will take place until the person centers the laser "sighting dot" on the target 20 yard distant, and he shoots.

Now suppose that the person decides that the bow pull weight is too strong and he adjusts the bow to have a lesser, e.g., 15 lb. lighter, pull weight, and suppose that the pull weight is lessened from 70 lbs. down to 55 lbs. When he does this he will need to shoot a different arrow which will be lighter in weight than the one that was required to shoot the 70 lb. pull weight.

IV. PRIOR ART CAPABILITY AND MOTIVATIONS, AS HELPING TO SHOW PATENTABILITY HERE

In hindsight consideration of the present invention to determine its inventive and novel nature, it is not only conceded but emphasized that the prior art had details usable in this invention, but only if the prior art had had the guidance of the present concepts of the present invention, details of both capability and motivation.

That is, it is emphasized that the prior art had or knew several particulars which individually and accumulatively show the non-obviousness of this combination invention. E.g., a. The prior art has long had bows and arrows of various types;

b. Laser details and the advantages of lasers as sight-assisting features are well known in the art;

c. The prior art has had the knowledge of the typical desire of assisting the aiming for utmost precision in hitting the target accurately;

d. The prior art knew the action of target animals in moving between locations in a considerable span of distance;

e. The prior art has been aware of the problems inherent as to differences in shooting length, nature of different bow and arrow features in consideration of size, shape, weight and "pulling strength";

f. The prior art of the industry has surely supposed or known that many customers have been and surely would be quite willing to purchase improved and more accurate and consistent shooting apparatus, providing not only an easy and convenient aiming apparatus, but one which attains high precision at various distances and elevations;

g. The industry and users have surely known that even novices would hope and expect to soon attain the skill of expert marksmen, and be willing to pay for this hopeful achievement;

h. The relative ease of tooling and overall simplicity of components of this shooting apparatus have surely given manufacturers ample incentive to have made modifications for commercial competitiveness in a competitive industry;

i. The prior art has always had sufficient skill to make many types of shooting aids, movable-parts products and various articles having a variety of parts, more than ample skill to have achieved the present invention, but only if the concepts and their combinations had been conceived;

j. Substantially all of the operational characteristics and advantages of details of the present invention, when considered separately from one another and when considered separately from the present invention's details and non-technical accomplishment of the details, are within the skill of persons of various arts, but only when considered away from the integrated and novel combination of concepts which by their cooperative combination achieves this advantageous invention;

k. The details of the present invention, when considered solely from the standpoint of construction, are relatively simple, and the matter of simplicity of construction has long been recognized as indicative of inventive creativity; and l. Similarly, and a long-recognized indication of inventiveness of a novel combination, is the realistic principle that a person of ordinary skill in the art, as illustrated with respect to the claimed combination as differing in the stated respects from the prior art both as to construction and concept, is that the person of ordinary skill in the art is presumed to be one who thinks along the line of conventional wisdom in the art and is not one who undertakes to innovate.

Accordingly, although the prior art has had capability and motivation, amply sufficient to presumably give incentive to the development of a bow accessory according to the present invention, the fact remains that the present invention awaited the creativity and inventive discovery of the present inventor. In spite of ample motivation and capability shown by the illustrations herein, the prior art did not suggest this invention.

V. SUMMARY OF THE PRIOR ART'S LACK OF SUGGESTIONS OF THE CONCEPTS OF THE INVENTION'S COMBINATION

In spite of all such factors of the prior art, the problem here solved awaited this inventor's present creativity. More particularly as to the novelty here of the invention as considered as a whole, the resume of the prior art uses and needs helps to show its contrast to the present concepts, and emphasizes the advantages, novelty, and the inventive significance of the present concepts as are here shown, particularly as to utility, accurately and convenience of use as detailed herein.

Moreover, prior art articles known to this inventor which could possibily be adapted for this duty fail to show or suggest the details of the present concepts as a combination; and a realistic consideration of the prior art's differences from the present concepts of the overall combination may more aptly be described as teaching away from the present invention's concepts, in contrast to suggesting them, even as to a hindsight attempt to perceive suggestions from a backward look into the prior art, especially since the prior art has long had much motivation as to details of the present invention and to its provisions.

And the existence of such prior art knowledge and related articles embodying such various features is not only conceded, it is emphasized; for as to the novelty here of the combination and of the invention as considered as a whole, a contrast to the prior art helps also to remind both the great variety of the various prior art articles and the needed attempts of improvement, and of the advantages and the inventive significance of the present concepts. Thus, as shown herein as a contrast to all the prior art, the inventive significance of the present concepts as a combination is emphasized and the nature of the concepts and their results can perhaps be easier understood.

Although varieties of prior art are conceded and ample motivation is shown and full capability in the prior art is conceded, no prior art shows or suggests details of the overall combination of the present invention as is the proper and accepted way of considering the inventiveness nature of the concepts.

That is, although the prior art may show an approach to the overall invention, it is determinatively significant that none of the prior art shows the novel and advantageous concepts in combination, which provides the merits of this invention, even though certain details are shown separately from this accomplishment as a combination.

And the prior art's lack of an invention of a shooting apparatus, achieving the convenience, accuracy, simplicity of use and other advantages of the present invention, which are goals only approached by the prior art, must be recognized as showing a long-known need, now solved.

Accordingly, the various concepts and components are conceded and emphasized to have been widely known in the prior art as to various devices; nevertheless, the prior art not having had the particular combination of concepts and details as here presented and shown in novel combination different from the prior art and its suggestions, even only a fair amount of realistic humility to avoid consideration of this invention improperly by hindsight requires the concepts and achievements here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art.

VI. BRIEF DESCRIPTION OF THE DRAWINGS

The above description of the novel and advantageous invention is of somewhat introductory and generalized form. More particular details, concepts, and features are set forth in the following and more detailed description of an illustrative embodiment, taken in conjunction with the accompanying Drawings, which are of somewhat schematic and diagrammatic nature for showing the inventive concepts; and in the Drawings.

Figure 3:
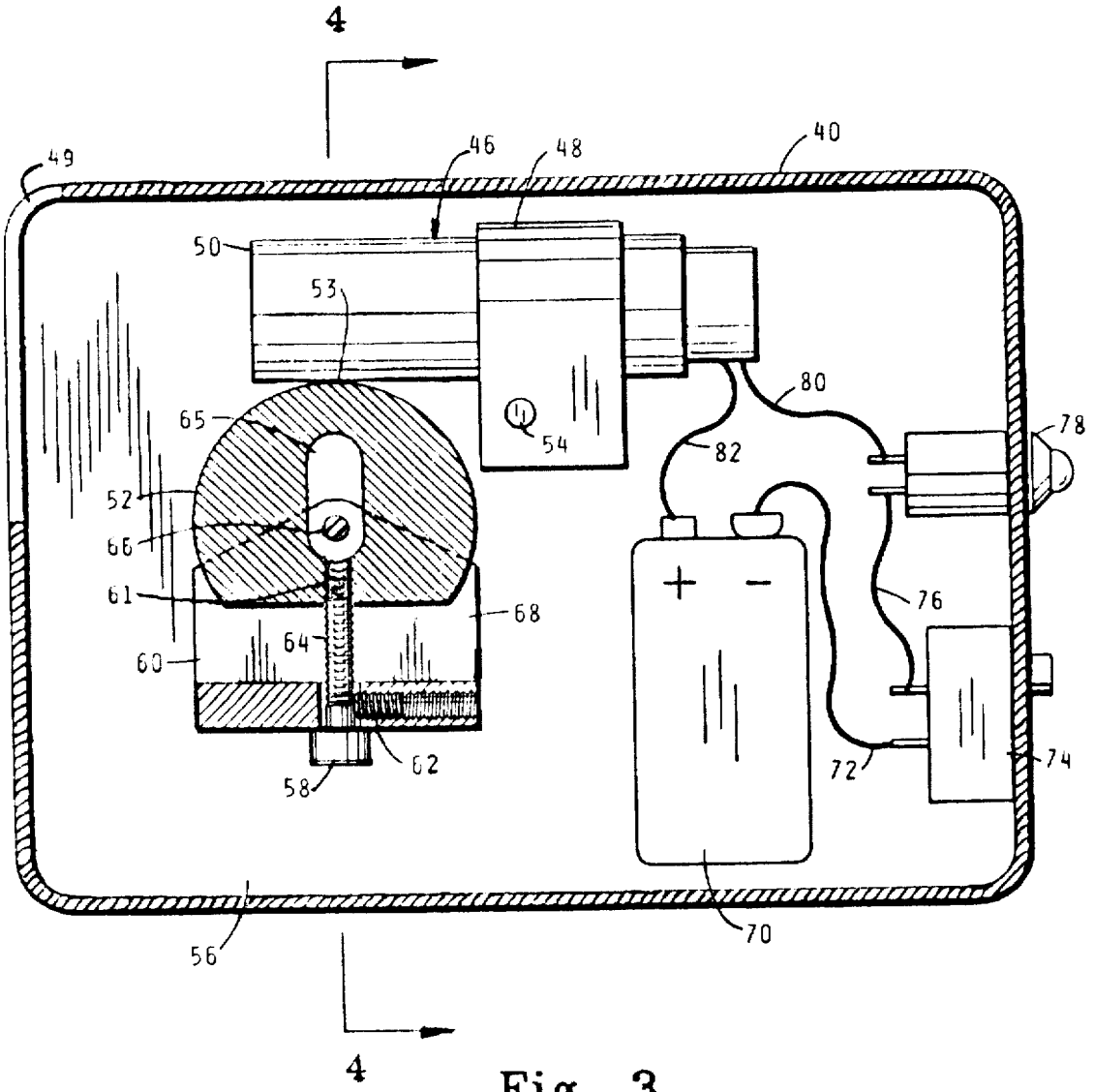
FIG. 3 is a vertical cross-sectional view of the containment housing, and internal components, shown generally as taken by Section line 3—3 of FIG. 4, but in smaller scale.
Figure 4:
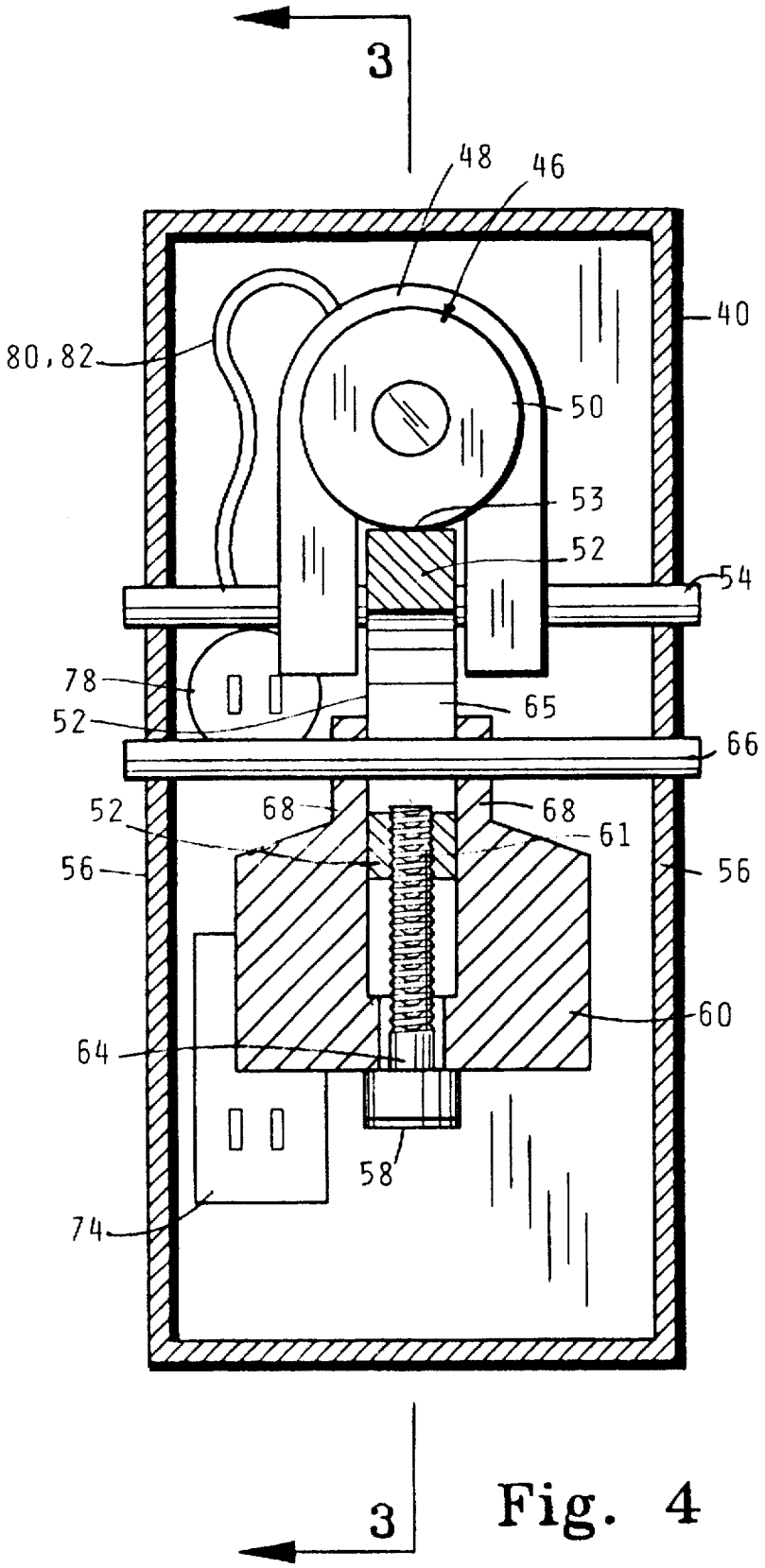
FIG. 4 is a vertical cross-sectional view shown generally as taken by Section line 4—4 of FIG. 3, but in larger scale.
Figure 5:
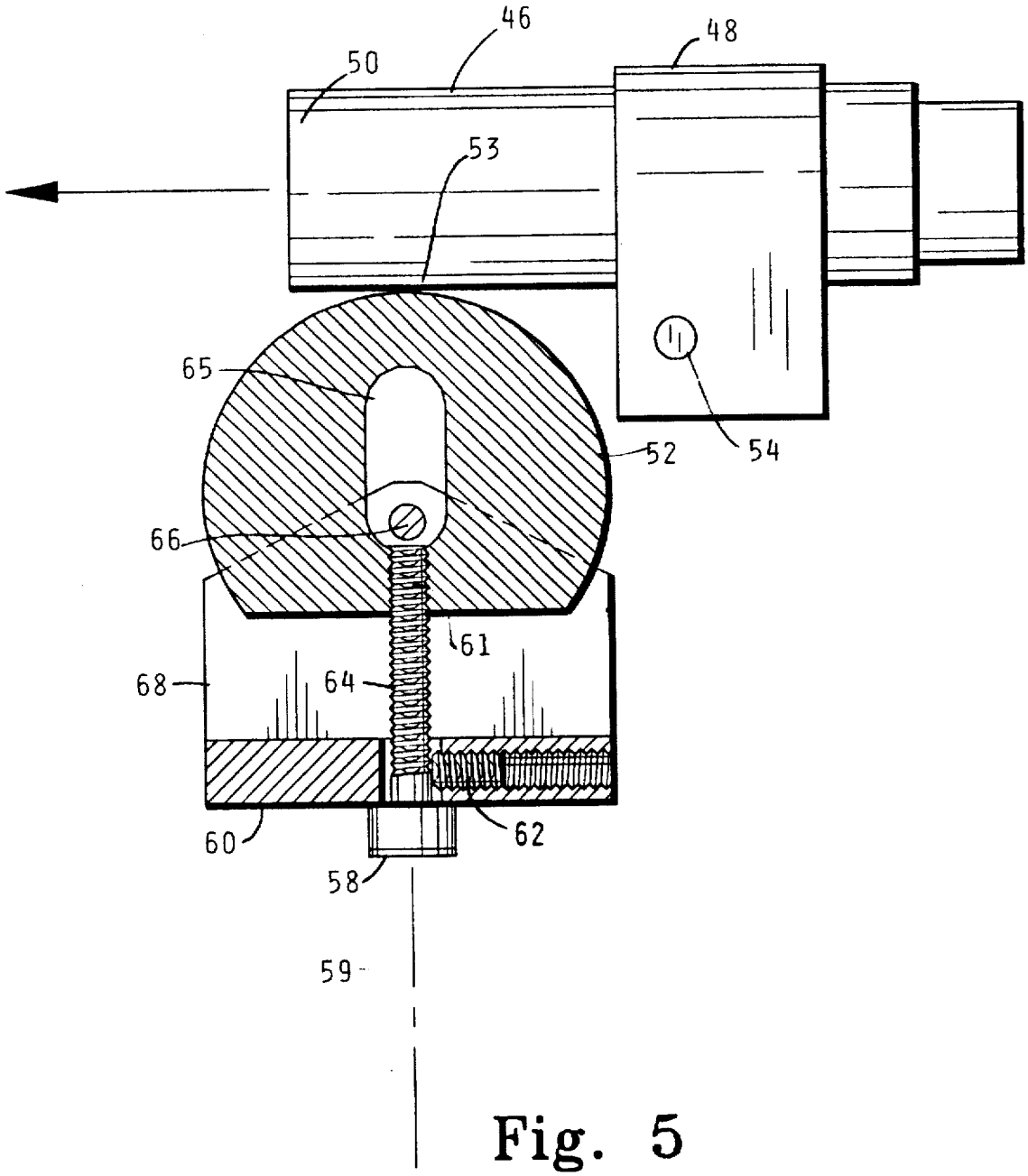
Figure 6:
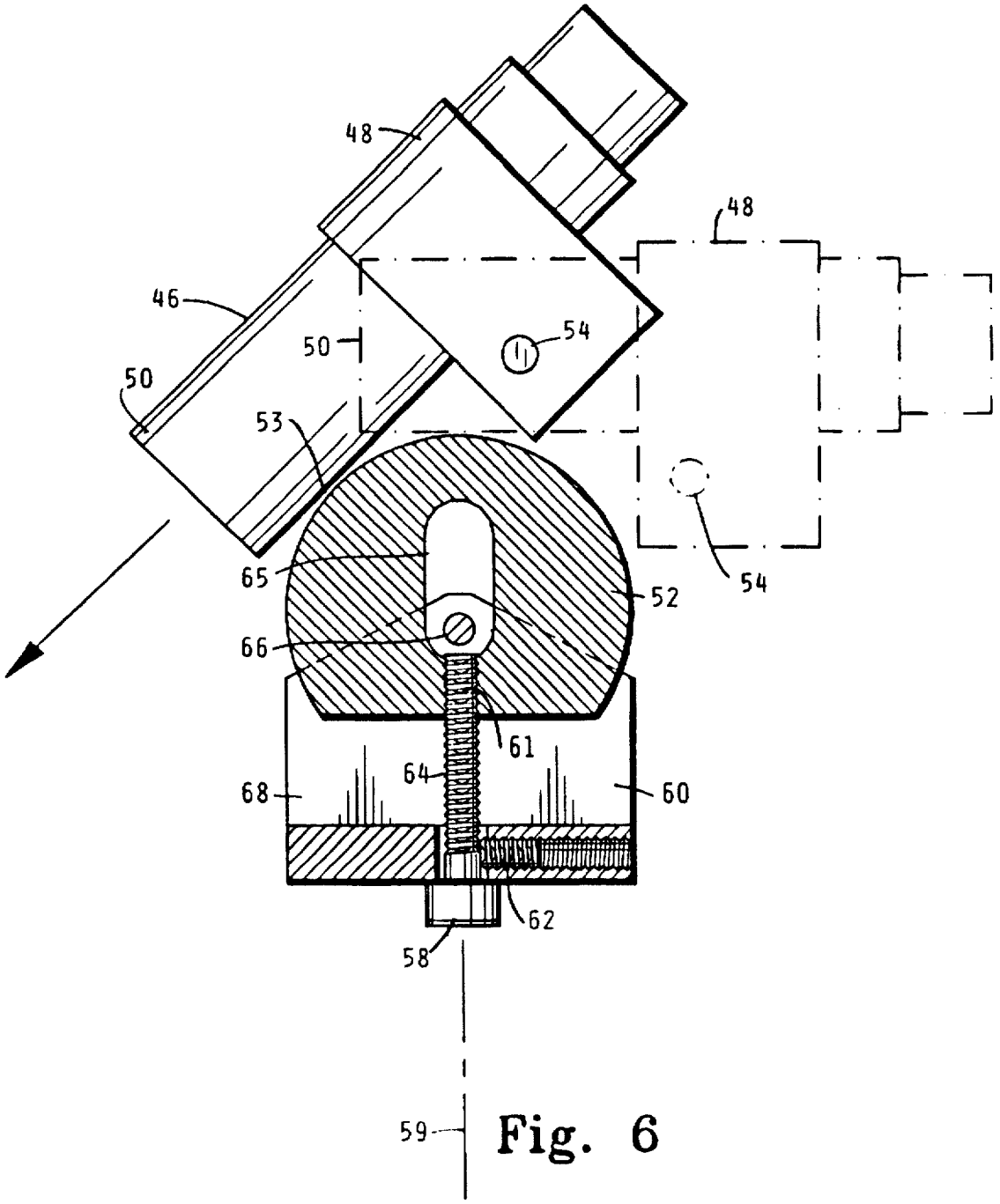
Figure 7:
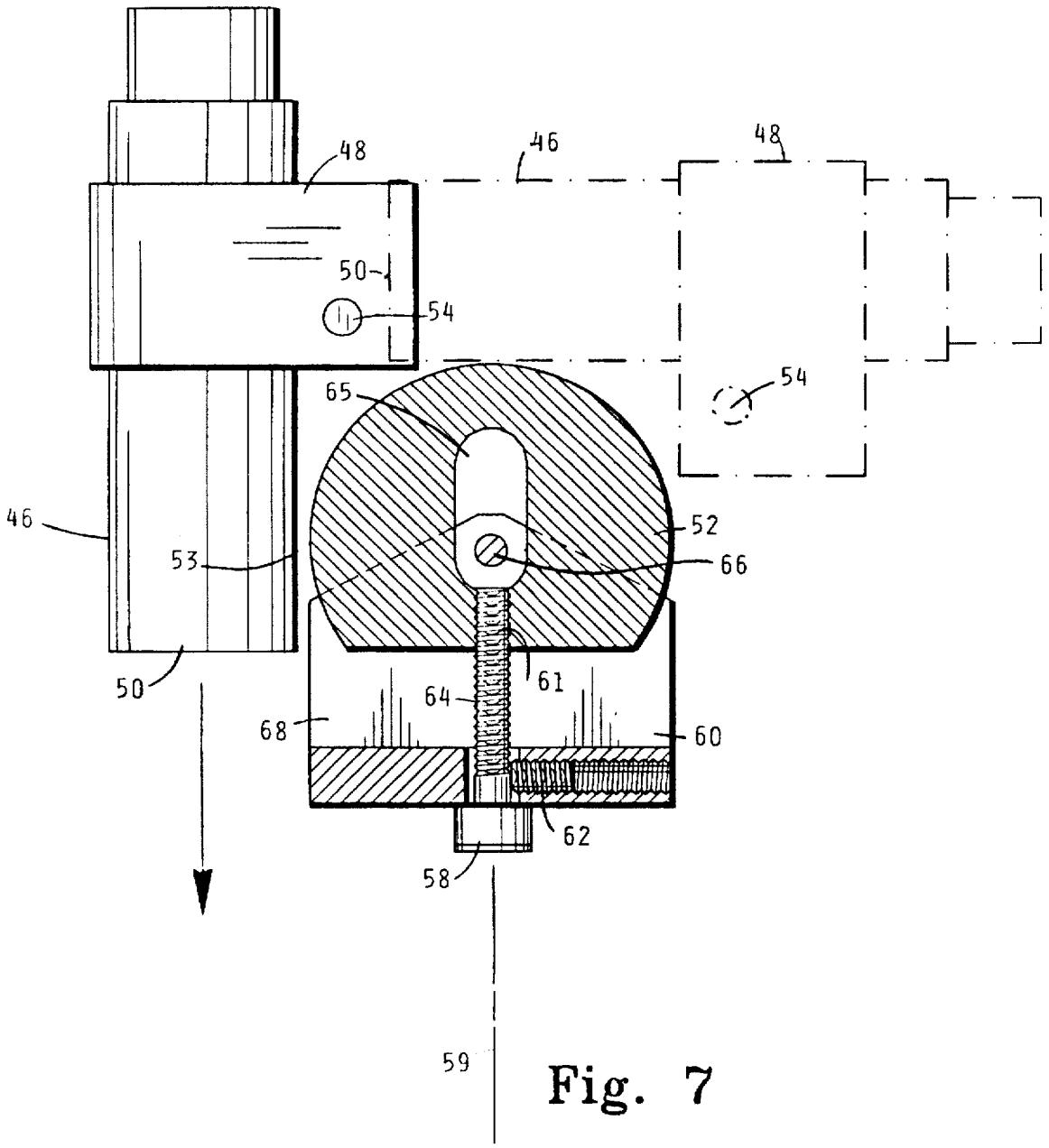
Figure 8:
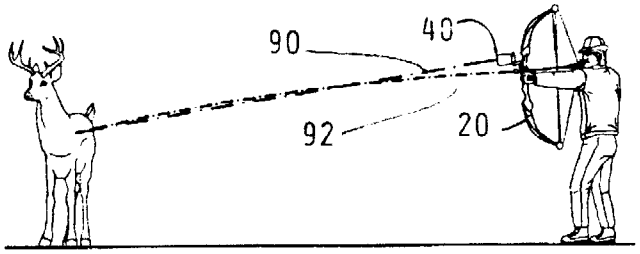
Figure 9:
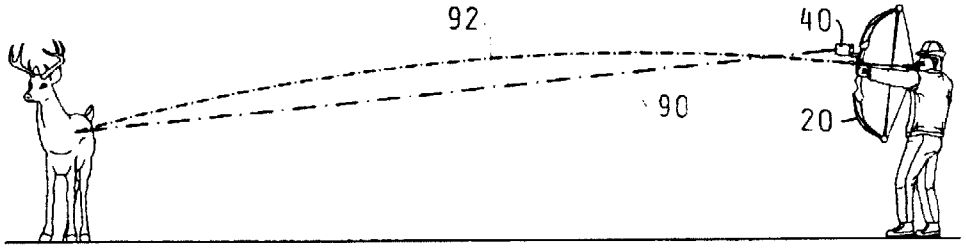
Figure 10:
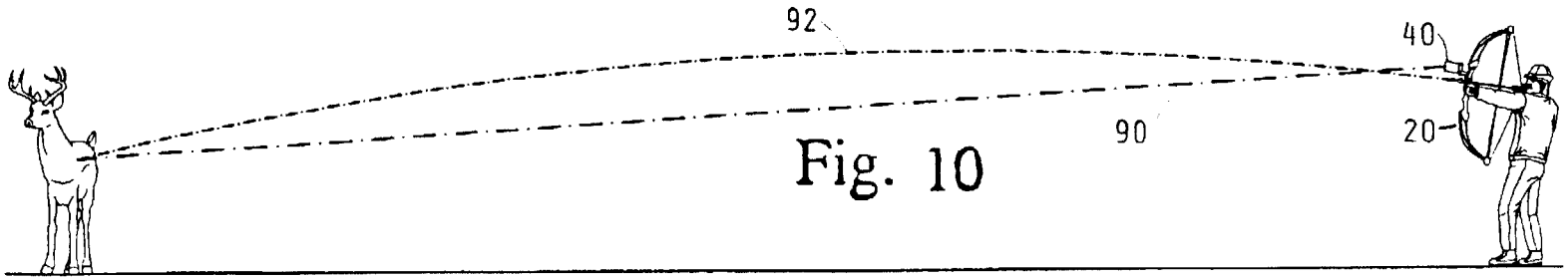
Figure 11:
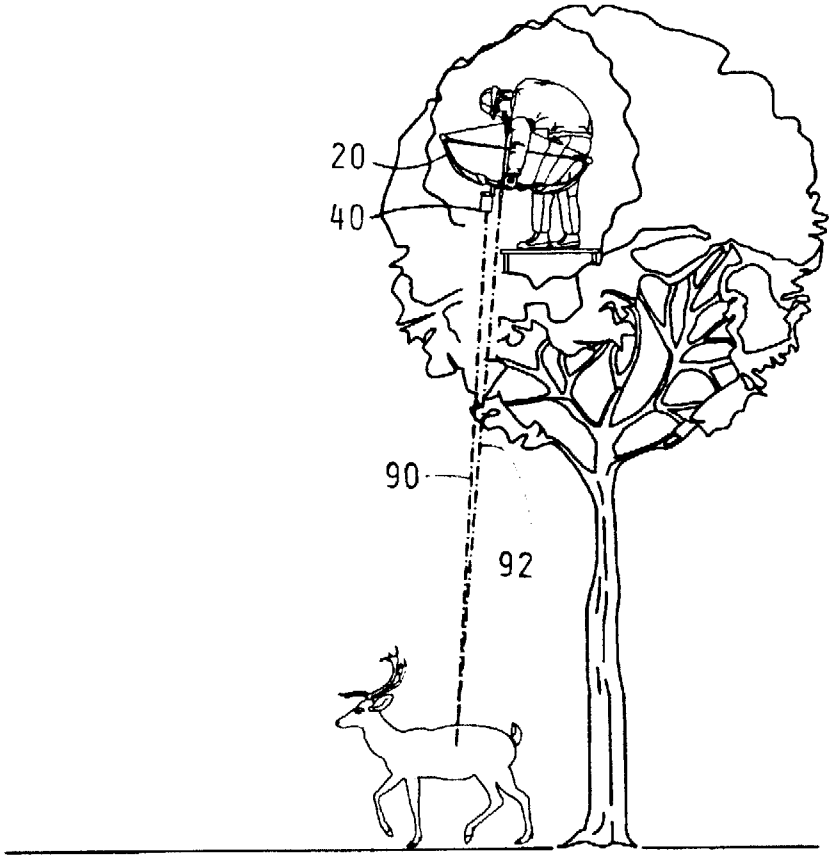
Figure 12:
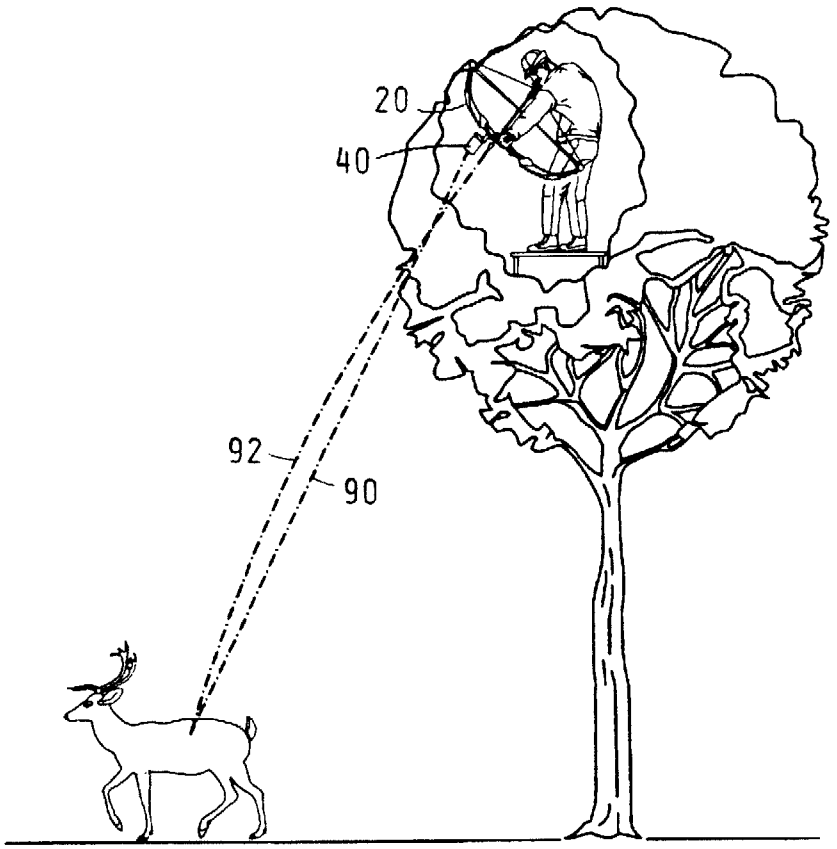
Figure 13:
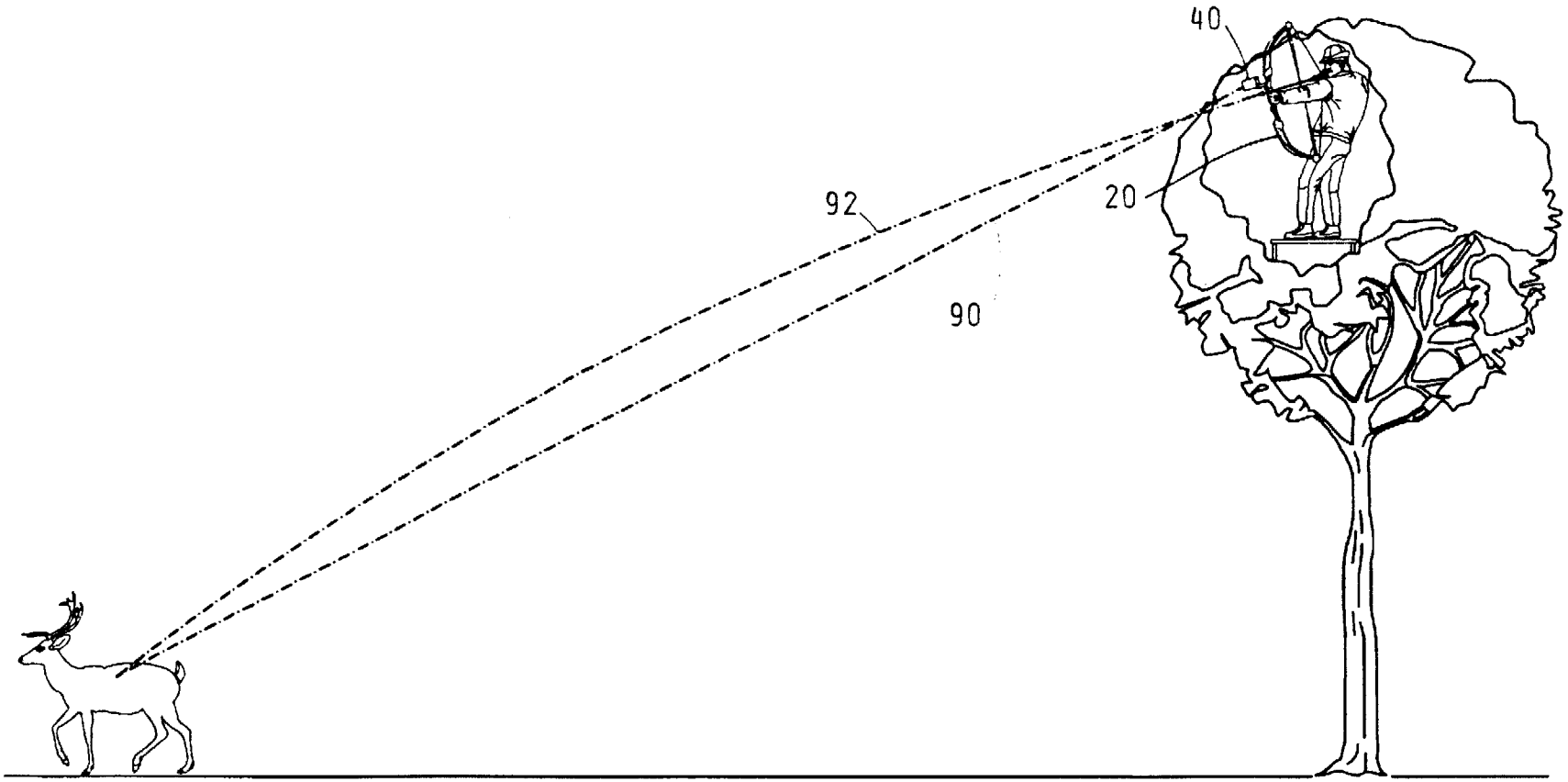

FIGS. 5, 6 and 7, generally in the scale shown in FIG. 4, are views of the cam body, supporting components and the laser unit, all three Figures showing a cam body at the same basic vertical adjustment shown in FIG. 3; and in this set:

FIG. 5 shows the parts in that position of basic-adjustment, as would be seen with the bow being held in a basic position in which the pendulum effect of cam-support provides that the inclination with the laser beam is horizontal;

FIG. 6 shows the parts as in FIG. 5 but with the bow being held at an intermediate downward inclination in which the axis of rotation of the laser unit is farther forward (left) than in FIG. 5, the laser unit being shown in chain lines in FIG. 6 to illustrate the difference in the position in which the bow is being held; and FIG. 7 shows the parts as in FIG. 5 but with the bow being held in a fully downward inclination in which the axis of rotation of the laser unit is farther forward (left) than in FIG. 6, the laser unit being shown in chain lines in FIG. 7 to illustrate the difference in the position in which the bow is being held;

FIGS. 8–10 are pictorial illustrations for indicating the hunter, the target animal and the trajectories of laser beam and the arrow's flight path, respectively at a close distance, an intermediate distance, and a relatively far distance, all as indicative of these features as existing with the hunter standing on the ground as the same elevation as the target; and FIGS. 11, 12, and 13, respectively similar to FIGS. 8–10, show laser beam trajectory and arrow trajectory at vertically downward, intermediate and relatively far distances, but with the hunter shown in a tree mount, typically 15 to 20 feet above the elevation of the target. "Listing of Components" which is included here as an attachment entitled "Appendix A".

VII. STRUCTURAL AND OPERATIONAL FEATURES

Figure 1:
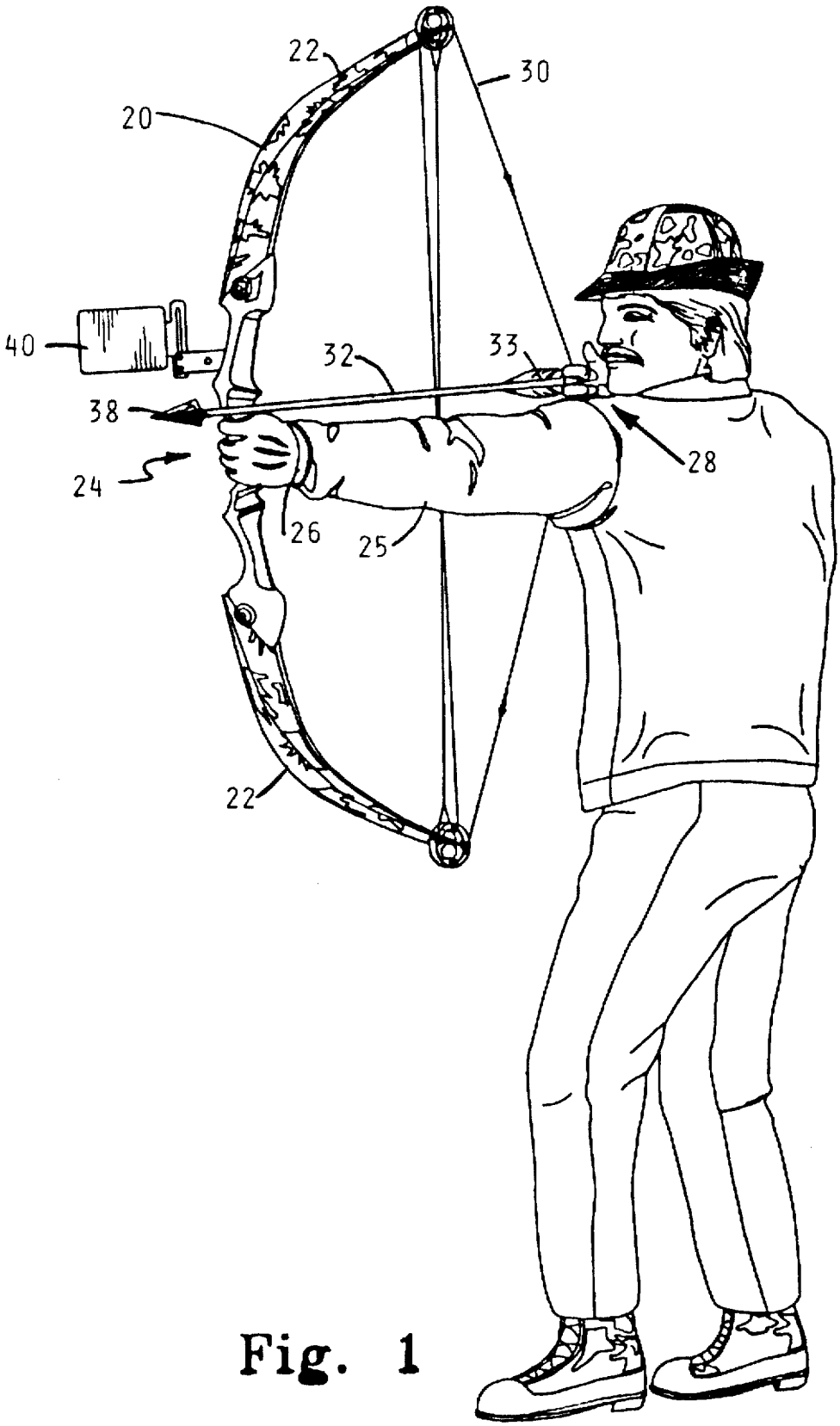
FIG. 1 is a side elevation view of a hunter holding a bow in the procedure of aiming an arrow, the bow being equipped with a laser control device according to the present invention.
Figure 2:
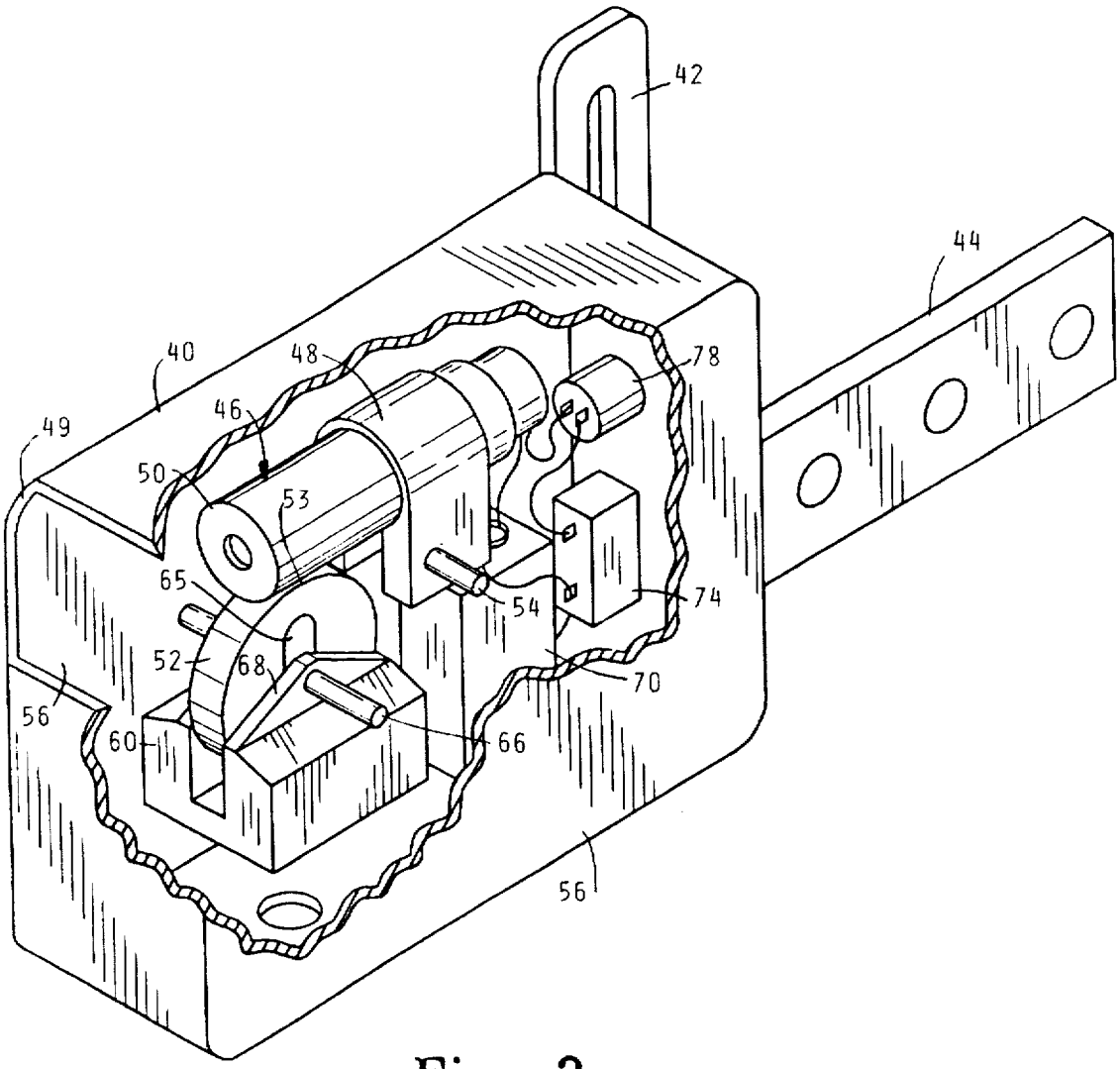
FIG. 2 is an isometric view of a laser containment housing of the type shown in FIG. 1 as mounted on the bow, with extensive portions of the housing being shown as broken away to make visible interior details.

The bow 20 is shown most fully in FIG. 1, as to its exterior details.

As there shown, the bow 20 is of an arcuate generally C-shape having portions often called limbs 22 outwardly of an intermediate portion often called a handle 24, the handle 24 being the part which is forcefully supported by the forward arm 25 and forward wrist 26 of the user, as he uses his rearward arm and hand 28 to pull back on the bow string 30, causing a resilient flexure in the bow limbs 22 which stores energy in the apparatus useful to propel the arrow 32 from its cocked position shown in FIG. 1, when he releases the string 30.

As of course is well known, the cocking of the apparatus by the user pulling on the bow string 30 and forward support of the arrow 32 by the user's forward hand 26 gives an aiming effect to the arrow 32, the aiming being achieved as the user's forward hand 26 is moved vertically and thus with respect to the rear end 33 of the arrow 32 whose elevation is substantially constant, being a function of the user's height and relative length of his rear arm-sections.

Accordingly, as is of course also well known, the user must elevate his forward hand 26 to achieve a relatively longer arrow 32 trajectory, due to the fact that the user must impart an upward component to the trajectory of the arrow's flight path to compensate for the effect of gravity.

The factors of distance to the target and resilience characteristics of the bow 20 of course are factors which must be accounted for in order for the arrow tip 38 to strike the target by being at the proper vertical height when the arrow 32 has traversed the trajectory to the target.

In the use of the laser sighting unit, the user will look specifically upon the target for the presentation or showing thereon of the laser's "sighting dot", in contrast to the sighting-use of a conventional bow and arrow assembly in which the user would "sight along" the arrow 32 to physically observe the initial inclination of the arrow's trajectory.

FIG. 1 illustrates this difference by showing that the hunter's vision is significantly away from the axis of the arrow.

Also, in considering the sighting and target-accuracy of this laser-guided sight system, it is assumed that the hunter's skill of aiming will laterally center the arrow and its trajectory sufficiently centrally of its lateral or horizontal trajectory, that the aiming details here discussed relate wholly to the vertical aiming aspect.

The sighting apparatus is best shown in detail in FIGS. 2–7. Its most apparent features are a containment housing 40 supported by a vertical bracket 42 and a horizontal bracket 44 onto the handle 24 of the bow 20. Within the housing 40 there is mounted a laser sight unit 46 supported by a mounting bracket 48, achieving a laser beam projected through a forward window 49 of the housing 40.

The sight unit 46 has a forward lens portion 50 which rests upon a cam 52, the supporting engagement (53) of the sight unit forward portion 50 on the cam 52 providing an adjustable angle of the sight unit 46, as carried by the mounting bracket 48 being rotatable about the axis of a support pin 54 which is carried by side walls 56 of the housing 40.

The cam 52 is shown as supported by and made vertically adjustable by an adjustment bolt 58 (turnable manually on axis 59) which is carried by a support bracket 60, and screw-threadedly connected (at 61) to cam 52, the vertical adjustment of the cam 52 by threads 61 being lockable by set screw 62 which is also carried by the bracket 60. The set screw 62 bears against the shank 64 of the adjustment bolt 58, fixing the connection of bolt 58 to the bracket 60.

The cam 52 has a vertical slot 65 which accommodates vertical movement of the cam 52 with reference to a horizontal support shaft or axle 66 which passes through the upper walls 68 of the support mount 60, the support shaft or axle 66 being also supported by the side walls 56 of the housing 40. The mount 60/68 is of a general U-shape.

Cam 52 is thus seen to be significant in one of the variations or adjustments mentioned, as changing the inclination of the laser unit 46 with reference to the bow 20 and housing 40. That is, as to the height-adjustment manually, by 58/64/61/52, the cam 52 with laser portion 50 at 53, merely by vertical adjustment of the cam 52 by screw 58, achieves that relative change.

As to the other variation of the inclination of the laser unit 46 with respect to the bow 20 and housing 40, this other variation is also achieved as a function of the cam 52, this being an operativity of the cam 52 maintaining a stationary position with respect to the earth even though the bow 20 moves the housing 40 when the user is changing the inclination of the bow, such as to change the overall distance of the trajectory of the arrow 32.

More particularly, the cam 52's stationariness, as caused by the pendulum-weighted support body 60, and its rotational support by axle 66 to the housing sidewalls 56 which causes support body 60 and cam 52 to not change orientation with respect to the earth (in spite of substantial angular changing of the orientation of the bow 20 in order to account for variation in distance which requires a variation in trajectory inclination), achieves a rotation of the cam 52 about the axis of axle 66, which also changes the location of engagement 53 between laser-portion 50 and the cam 52.

This change of angle between the laser unit 46, with respect to the bow 20 and housing 40, is diagrammatically shown by comparing FIGS. 5, 6 and 7, which indicate the position of the bow 20 and housing 40 by the axle 54, which is the only component of the bow 20 and housing 40 shown on those views, it being shown in full lines in those views in its position of variation, and in chain lines in its basic position (as in FIGS. 3 and 5).

The energization of the sight unit 46 is by a battery 70, having a wire 72 which leads to one pole of a switch 74, the other pole of the switch 74 being connected by a wire 76 to one terminal of an indicator light 78, the other pole of which leads to the sight unit 46 by a wire 80, the circuit through the sight unit 46 being then completed by a wire 82 leading back to the battery 70.

The two sets of Figures, i.e., the set of FIGS. 8–10 and the set of FIGS. 11–13, illustrate particulars with the use of the sight system of the present invention.

In FIGS. 8–10, the views diagrammatically illustrate the line of the laser beam 90 in comparison to the curving trajectory of the arrow trajectory 92, both of which strike the target animal in the same spot even though the distances are different and the angles are different at which the bow 20 is held in order to achieve the operative trajectory 92 of the arrow.

FIGS. 11–13 illustrate the same features, but with the hunter operating from an elevated or "tree mount" position; and again the laser beam trajectory is indicated at 90 and the arrow's trajectory is indicated at 92.

VIII. INVENTION IN SUMMARIZED DESCRIPTION

As a numerically-designated review, it will be seen that the laser unit 40 provides a change of the angle of the laser beam 90 of laser 46 with respect to the housing framework 40 by two features, both of which utilize the cam 52 and its engagement 53 with the laser's forward portion 50.

That supportive engagement 53 provided to be changeable by two control means which vary the relative position of the cam 52, permitting the laser device 46 to rotate about a rearward axle 54 as the cam 52 rotates about its forward axle 66.

More particularly, the components provide a support means 48/54 and/or 50/53/52/61/64/58/60/68/66/56, both supporting the laser device 46 by the housing framework 40; and the means for varying the position of the laser device 46 by movement of the cam 52 are the features 58 and the combination of features 20/40/56/54/48, the first of which is the adjustment screwhead 58 and the other of which is achieved by movement of the bow 20 as the cam assembly 52/60/68 is held at a constant orientation with respect to the earth, by the weight of the cam assembly 52/60/66 which permits rotation about the axle 66.

IX. SUMMARY OF COMPONENTS AND OPERATIONAL DETAILS AND THEIR ADVANTAGES

The present invention as detailed herein has advantages in both concept and in component parts and features; for in contrast to other articles known to the inventor as to the prior art the invention provides advantageous features which should be considered, both as to their individual benefit, and to whatever may be considered to be also their synergistic benefit toward the invention as a whole:

a. Extremely accurate for precision shooting;

b. Even novices can show great skill in marksmanship;

c. Ability to easily and quickly change for differences in distance and elevation;

d. Adjustability for various arrows and pulling factors; and, e. Advantages without contrasting disadvantages.

X. CONCLUSION

It is thus seen that a bow and arrow shooter's attachment, used according to the combination of inventive concepts and details herein set forth, provides novel concepts of a desirable and usefully advantageous article, yielding advantages which are and which provide special and particular advantages when used as herein set forth.

In summary as to the nature of the overall article's advantageous concepts, their novelty and inventive nature is shown by novel features of concept and construction shown here in advantageous combination and by the novel concepts hereof not only being different from all prior art known, even though other aiming attachments for bow and arrow assemblies and for rifles and shotguns have been known and used for scores of years, but because the achievement is not what is or has been suggested to those of ordinary skill in the art, especially realistically considering this as a novel combination comprising components which individually are similar in nature to what is well known to most all persons, surely including most of the many makers of bow and arrow apparatus for a great number of years throughout the entire world. No prior art component or element has even suggested the modifications of any other prior art to achieve the particulars of the novel concepts of the overall combination here achieved, with the special advantages which the overall combination article provides; and this lack of suggestion by any prior art has been in spite of the long worldwide use of various types of bow and arrow equipment.

The differences of concept and construction as specified herein yield advantages over the prior art; and the lack of this invention by the prior art, as a prior art combination, has been in spite of this invention's apparent simplicity of the construction once the concepts have been conceived, in spite of the advantages it would have given, and in spite of the availability of all of the materials to all persons of the entire world, and the invention's non-technical and openly-visible nature.

Quite certainly this particular combination of prior art details as here presented in this overall combination has not been suggested by the prior art, this achievement in its particular details and utility being a substantial and advantageous departure from prior art, even though the prior art has had similar components for numbers of years. And particularly is the overall difference from the prior art significant when the non-obviousness is viewed by a consideration of the subject matter of this overall device as a whole, as a combination integrally incorporating features different in their combination from the prior art, in contrast to merely separate details themselves, and further in view of the prior art of shooting apparatus articles not achieving particular advantages here achieved by this combination.

Accordingly, it will thus be seen from the foregoing description of the invention according to the illustrative embodiment, considered with the accompanying drawings, that the present invention provides new and useful concepts of a novel and advantageous article, possessing and yielding desired advantages and characteristics in formation and use, and accomplishing the intended objects including those hereinbefore pointed out and others which are inherent in the invention.

Modifications and variations may be effected without departing from the scope of the novel concepts of the invention; accordingly, the invention is not limited to the specific embodiment, or form or arrangement of parts herein described or shown.

XIV. APPENDIX A
LISTING OF COMPONENTS

| | |
|---|---|
| 20 | BOW |
| 22 | LIMBS |
| 24 | HANDLE |
| 26 | WRIST (FORWARD) |
| 28 | REAR HAND/ARM |
| 30 | STRING |
| 32 | ARROW |

-continued

XIV. APPENDIX A
LISTING OF COMPONENTS

| | |
|---|---|
| 33 | ARROW REAR END |
| 38 | ARROW TIP |
| 40 | HOUSING |
| 42 | VERTICAL BRACKET |
| 44 | HORIZONTAL BRACKET |
| 46 | LASER SIGHT UNIT |
| 48 | U-shaped MOUNTING BRACKET (ROTATABLE RE. 54) |
| 48/54 | REAR SUPPORT MEANS |
| 49 | WINDOW |
| 50 | LENS OF 46 (FORWARD) |
| 50/53/52/61/64/58/60/68/66/56/40 | FORWARD SUPPORT MEANS |
| 52 | CAM |
| 52/60/68 | CAM ASSEMBLY |
| 53 | 50 ON 52, FOR ADJ. ANGLE OF 46 |
| 54 | SUPPORT PIN OF 48 CARRIED BY SIDE WALLS 56 of 40 |
| 56 | SIDE WALLS OF 40 |
| 58 | ADJ. BOLT ON 60 FOR 52 TO CHANGE INCLINATION OF 46 |
| 58/60/64/61/52/53/50/46/48/54/56/40 | FIRST ADJUSTMENT OF 46/20 |
| 59 | AXIS OF 58 |
| 60 | WEIGHTED SUPPORT BRACKET FOR 58 |
| 60/68/66/56/53/50/46/48/54/56/40 | A SECOND ADJUSTMENT of 46/20 |
| 61 | SCREW CONN FOR 58/52 |
| 62 | SET SCREW FOR 58/52 |
| 64 | SHANK OF 58 |
| 65 | SLOT IN 52 FOR 52 |
| 66 | AXLE IN 65 OF 52 HELD IN 68 AND 56 of 40 |
| 68 | WALLS OF 60 |
| 70 | BATTERY |
| 72 | WIRE |
| 74 | SWITCH |
| 76 | WIRE |
| 78 | LIGHT |
| 80 | WIRE |
| 82 | WIRE |
| 90 | LINE OF LASER BEAM |
| 92 | CURVING ARROW TRAJECTORY |

I claim:

1. A laser unit having a laser device (46) for guidance of an arrow (32) to be propelled by a bow (20), the laser device (46) being productive of a laser beam (90) having a beam inclination by which the beam is to impinge upon the target with a visible reflection indicator on the target, the laser unit comprising, in combination with its laser device (46), a framework (40) which is operatively connected to the bow (20), support means (52/48) movably supporting the laser device (46) by the framework (40), means (60/52/48) for movably varying the position of the laser device (46) with respect to the framework (40), by which the location of the reflection indicator on the target provides the user with visible guidance for holding the bow (20) in a position such that the arrow (32) will strike the target operatively adjacent the reflective indicator on the target, and one of the said support means (60/52/48) comprises an adjusting device (58), and means (60/66) supportively connecting said adjusting device (58) to the framework (40), and comprising a first intermediate support means (60) to which the adjusting device (58) is vertically movably engageable, the said one of said support means (60/52/48) comprising a cam (52) whose surface provides a vertically adjustable non-rotational control surface which is operatively engageable with the laser device (46) for controlling the position of said laser device (46) and thus its inclination with respect to the framework (40).

2. A laser unit according to claim 1, in a combination in which the means (60/66) supportively connecting the adjusting device (58) to the framework (40) comprise second (68) and third (66) intermediate support means, the second intermediate support means (68) being operatively connected to the said adjusting device (58) and to the third intermediate support means (66), and the third intermediate support means (66) being connected to the second intermediate support means (68) and to the framework (40).

3. A laser unit according to claim 2, in a combination in which there is a freely rotatable connection of second intermediate support means (68) and the framework (40).

4. A laser unit according to claim 3, in a combination in which the assembly of the first (60) intermediate and second (68) intermediate support means is provided with a heavy ballast means of sufficient weight that the first intermediate support means (60) will automatically maintain an operatively steady orientation with respect to the framework (40) with respect to the earth, regardless of the setting the said adjustment device (58).

5. A laser unit according to claim 4, in a combination in which the cam (52) is provided with an opening means (65), and the third intermediate support means (66) passes through said opening means (65).

6. A laser unit according to claim 5, in a combination in which said opening means (65) of the cam (52) is of elongated nature accommodating relative vertical movement of the cam (52) and the third (66) intermediate support means.

7. A laser unit according to claim 1, in a combination in which the adjusting device (58) comprises a threaded bolt.

8. A laser unit having a laser device (46) for guidance of an arrow (32) to be propelled by a bow (20), the laser device (46) being productive of a laser beam (90) having a beam inclination by which the beam is to impinge upon the target with a visible reflection indicator on the target, the laser unit comprising, in combination with its laser device (46), a framework (40) which is operatively connected to the bow (20), support means (52/48) movably supporting the laser device (46) by the framework (40), means (60/52/48) for movably varying the position of the laser device (46) with respect to the framework (40), by which the location of the reflection indicator on the target provides the user with visible guidance for holding the bow (20) in a position such that the arrow (32) will strike the target operatively adjacent the reflection indicator on the target, the means (60/52/48) for movably varying the position of the laser device (46) with respect to the framework (40) being provided by a portion (48) of said support means (60/52/48) providing a rotatable connection (54) of the laser device (46) with respect to the framework (40), the varying means (60/52/48) including a cam (52) which provides support for the laser device, and a freely movable weighted support body (60) which causes the cam (52) to not change orientation with respect to the earth, regardless of the orientation of the bow (20) and of the framework (40) with respect to the earth.

* * * * *